US007344386B2

(12) United States Patent
Michida

(10) Patent No.: US 7,344,386 B2
(45) Date of Patent: Mar. 18, 2008

(54) ELECTRICAL CONNECTOR

(75) Inventor: Yohei Michida, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 11/730,165

(22) Filed: Mar. 29, 2007

(65) Prior Publication Data

US 2007/0232092 A1 Oct. 4, 2007

(30) Foreign Application Priority Data

Mar. 29, 2006 (JP) ..... 2006-091349

(51) Int. Cl.
*H01R 12/00* (2006.01)

(52) U.S. Cl. ..... 439/74

(58) Field of Classification Search ..... 439/74, 439/660

See application file for complete search history.

(56) References Cited

U.S. PATENT DOCUMENTS 5,224,866 A * 7/1993 Nakamura et al. ..... 439/81
6,296,524 B1 * 10/2001 Goto ..... 439/660
6,579,744 B1 * 6/2003 Jiang ..... 438/106

FOREIGN PATENT DOCUMENTS

JP 2001-143801 5/2001

* cited by examiner

*Primary Examiner*—Tulsidas C. Patel
*Assistant Examiner*—Phuongchi Nguyen
(74) *Attorney, Agent, or Firm*—Kubotera & Associates, LLC

(57) ABSTRACT

An electrical connector includes a housing (2) made of an insulative material and a terminal (3) made by bending a metal sheet in its thicknesswise direction and molded together with the housing (2). The terminal (3) has a contact portion (8A) indented from a surface on which a mating terminal (25) slides in its longitudinal direction. The indented contact portion (8A) is made of a curved surface that extends from both side edges (11) of the terminal toward its bottom center.

3 Claims, 6 Drawing Sheets

ELECTRICAL CONNECTOR

BACKGROUND OF THE INVENTION

1. Field of the Invention

The present invention relates to electrical connectors and, particularly, to an electrical connector that the terminal is molded together with the housing.

2. Description of the Related Art

An example of the electrical connector of this type is disclosed in JP 2001-143801.

As shown in FIG. 7, a connector 50 includes a housing 51 and terminals 52 that are molded together with the housing 51 as a unit. The terminal 52 is made by bending a metal strip in its thicknesswise direction to provide a connection section 53 and a contact section 54 indented from a peripheral portion 55 that is level with the surface of the housing 51.

A mating connector 60 includes a housing 61 and terminals 62 that are press fitted into the housing 61. These terminals 62 are made by stamping a metal sheet to provide a press-fit section 64, a connection section 65 extending to the right from a base section 63, and a flexible arm 66 extending to the left and then upward. The flexible arm 66 has a curved free end to form a contact portion 67. The terminal 62 is held by press fitting the press-fit section 64 into a retention slot 61A of the housing 61.

In use, the contact portion 67 of the mating connector 60 enters in the contact portion 54, which is intended from the peripheral portion 55, to provide stable contact.

The connector 50 is made such that the peripheral portion 55 of the terminal 52 does not come to so close contact with the mold that the molten resin enters and sticks to the contact section 54. The contact portion 54 of the above connector is made by pressing a die onto a metal sheet. It is desirable that the width of the contact portion 54 is large so that the width of a peripheral edge 55 becomes very small.

If the die is displaced to either side from the regular position, no side edge is formed on the side, resulting in a large gap between the metal mold and the terminal. Consequently, molten resin enters and adheres to the contact portion 54, leading to poor contact with the terminal of a mating connector. In addition, the lateral displacement limits the width of the contact area with the terminal of a mating connector. Consequently, the terminal of a mating connector can ride on the side edge of the contact portion, resulting in an unstable contact.

Accordingly, it is an object of the invention to provide an electrical connector capable of preventing molten resin from entering the contact portion even if the die is displaced in its widthwise or thicknesswise direction and providing a stable contact with the terminal of a mating connector.

An electrical connector related to the invention includes a housing made of an insulative material; a terminal made by bending a metal strop in its thicknesswise direction and molded together with the housing for support.

According to the invention, in the above connector, a contact portion is indented in the terminal so as to provide a curved longitudinal surface that extends from its side edges to its center gradually deepened.

Since the indented contact surface is sloped from the edges to the center, the gap between the mold and the terminal is so small that the molten resin, which has a viscosity, does not enter the gap. In addition, the terminal of a mating connector is displaced slightly in the widthwise or thicknesswise direction, it is brought into contact with the sloped surface at some point without failure, thus providing a stable contact.

The indented portion may be made such that tangents to the side edges and a tangent to the bottom share a common circle having a diameter that is greater than a distance between the side edges. The larger the diameter of the common circle, the smaller the slope so that the terminal of a mating connector is stabilized. The indented portion made of an arc of the common circle in its widthwise direction to provide a smooth surface in the widthwise direction.

The indented portion has a sloped end face in its longitudinal direction. The sloped end face has a distance that increases from the side edge to the bottom center. Consequently, the terminal of a mating connector is brought into contact with the surface of a side edge first and then guided to the center surface. The the indented portion may have a stepped end face in its longitudinal direction, producing a sensation of click upon engagement with the mating terminal, thus feeding it back to the user.

According to the invention, the side edges of an indented contact portion are sloped so that even if the press die is displaced in the widthwise or thicknesswise direction of a terminal, the gap between the mold and the terminal is so small that no or little molten resin does not reach the contact portion. In addition, the mating terminal becomes stable on the sloped surface.

DESCRIPTION OF THE PREFERRED EMBODIMENTS

Figure 1:
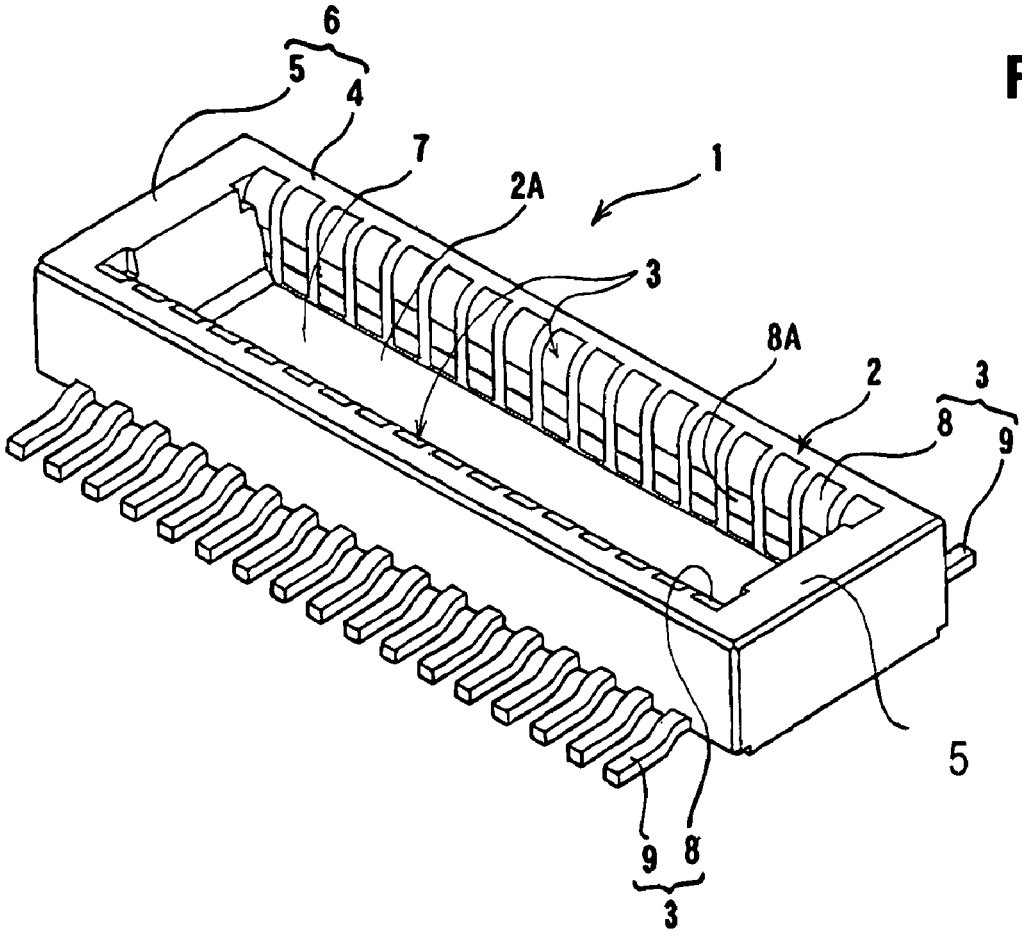
FIG. 1 is a perspective view of a connector according to an embodiment of the invention.

Embodiments of the invention will now be described with reference to the accompanying drawings FIGS. 1-6.

A connector 1 includes a housing 2 made of an insulative material and terminals 3 molded together with the housing 1 as a unit. The housing 2 has a peripheral wall 6 consisting of a pair of opposed longitudinal walls 4 and a pair of opposed end walls 5. The peripheral wall 6 and a bottom wall 7 form a cavity 2A for receiving a mating connector. The terminal 3 is made by bending a metal strip in its thicknesswise direction to provide an engaging section 8 with a contact portion 8A for contact with a terminal of the mating connector and a connection section 9 projecting from the housing 1 for connection to a circuit board (not shown).

Figure 2:
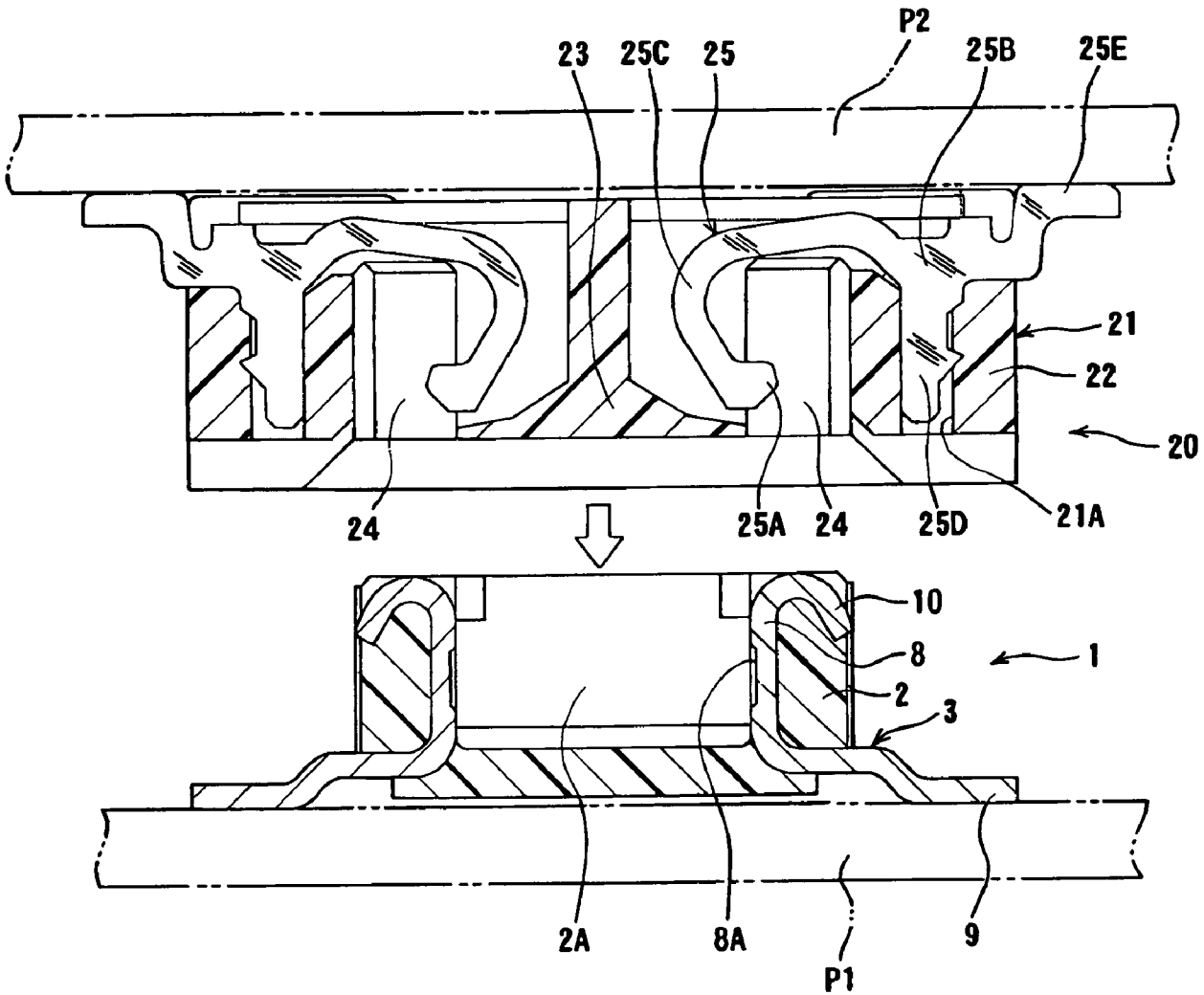
FIG. 2 is a sectional view of the connector and a mating connector before plugging.
Figure 3:
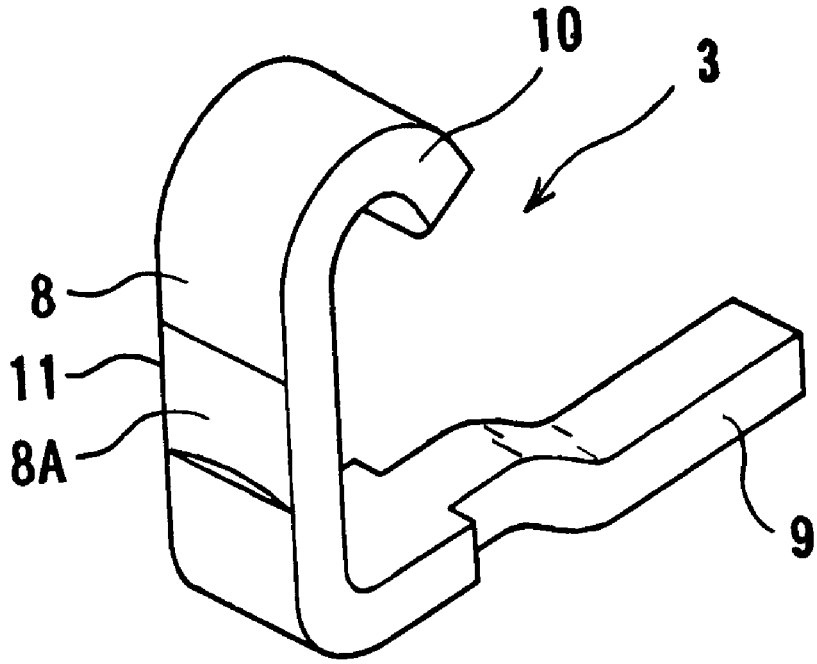
FIG. 3 is a perspective view of a terminal for use in the connector.

As shown in FIG. 2, the terminal 3, which has such a shape as shown in FIG. 3, is molded with and supported by the housing 2.

As shown in FIG. 3, the terminal 3 is made by bending a metal strip in its thicknesswise direction to provide a substantially L-shaped form that has the vertical flat section 8 and the horizontal connection section 9. The end portion of the vertical section 8 is curved to provide a curved portion 10 which increases the retaining power of the housing 2. This curved portion 10 also assures smooth introduction of the terminal of a mating connector. The engaging section 8 is level with the inside surface of the side wall 4 and is provided with an indented contact portion 8A.

Figure 4:
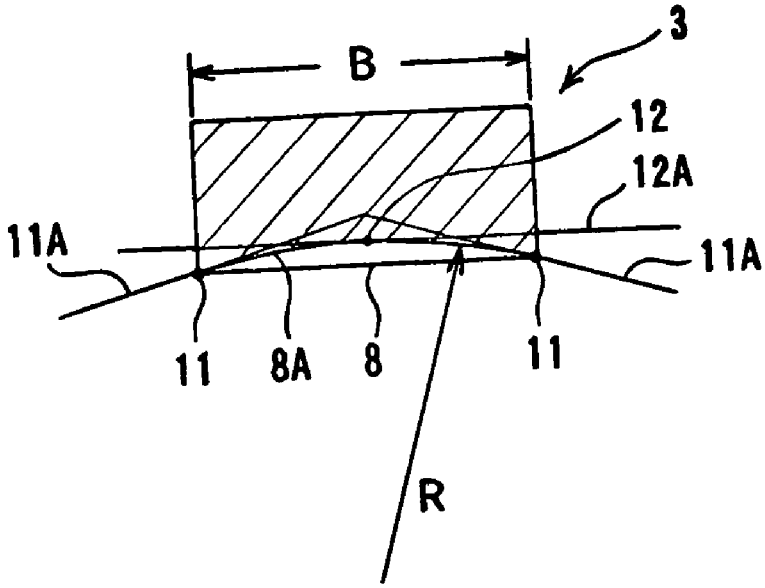
FIG. 4 is a cross-sectional view of a contact portion of the terminal.
Figure 5:
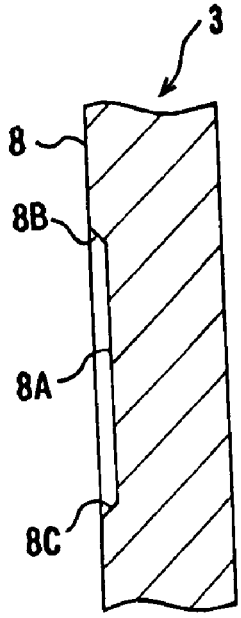
FIG. 5(A) is a front elevational view of the contact portion of the terminal.
FIG. 5(B) is a sectional view taken along line B-B of FIG. 5(A)
FIG. 5(C) is a sectional view taken along line C-C of FIG. 5(A)
Figure 5:
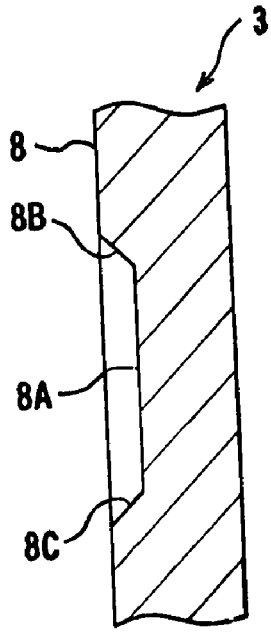
Figure 5:
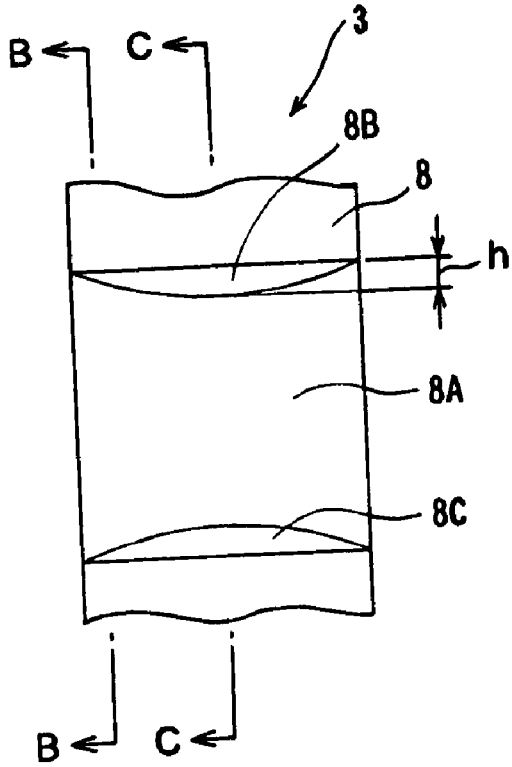
Figure 6:
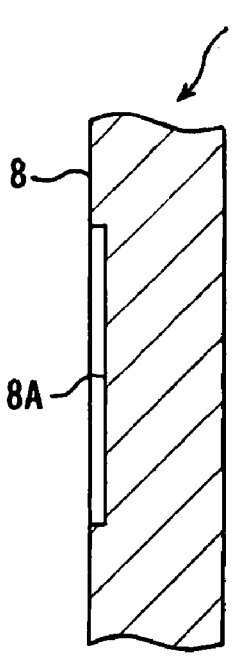
FIG. 6(A) is a front elevational view of a contact portion according to another embodiment of the invention.
FIG. 6(B) is a sectional view taken along B-B of FIG. 6(A)
FIG. 6(C) is a sectional view taken along C-C of FIG. 6(A)
Figure 6:
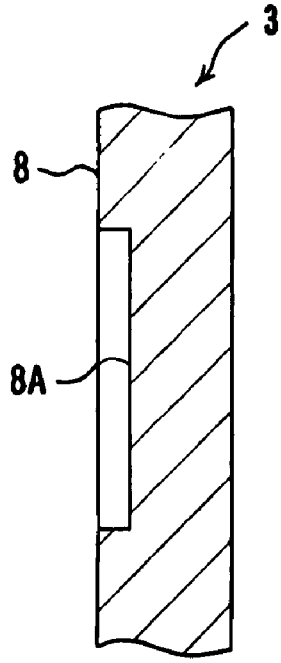
Figure 6:
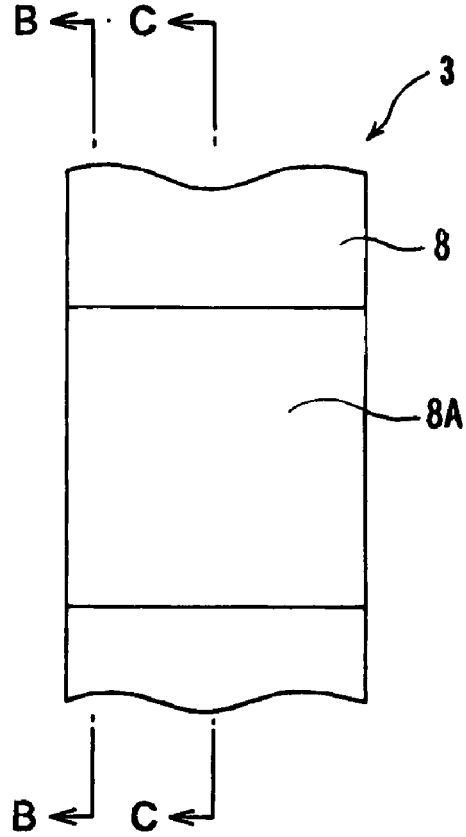
Figure 7:
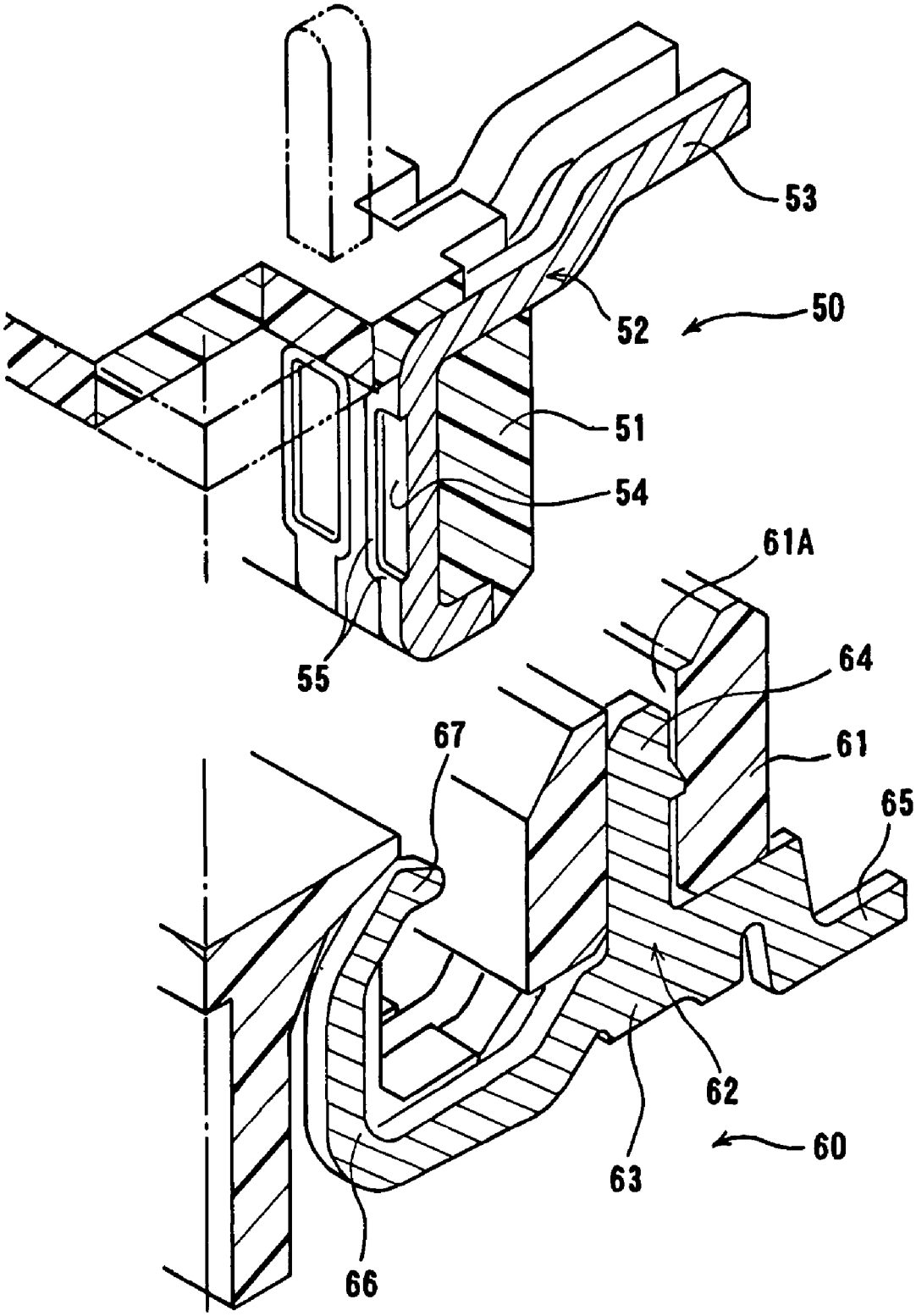
FIG. 7 PRIOR ART
FIG. 7 is a perspective sectional view of a conventional connector and a mating connector.

As shown in FIG. 4, the contact portion 8A is made of a curved surface that is a portion of cylinder having a radius R. The diameter 2R is greater than the width B of the contact portion 8A so that the contact portion 8A has the slope of a tangent 11A to the side edge 11 of the terminal 3. The tangent 12A to the center 12 of the width becomes parallel to the plane of the terminal 3. The tangents 11A at both side edges 11 and the tangent 12A at the center 12 share a common circle. Alternatively, the contact portion 8A may be made of other surfaces such as three flat surfaces; two tangents to the side edges 11 and one tangent to the center 12. These flat surfaces may be connected with curved surfaces. The three tangents may contact different circles.

As shown in FIGS. 5(A)-(C), the contact portion 8A, which is made of a portion of cylinder, has sloped upper and lower end faces 8B and 8C in the vertical or longitudinal direction. The depth of the contact portion 8A becomes the maximum at the center and smaller toward the side edges so that the distance h becomes the maximum at the center and smaller toward the side edges. Consequently, the contact portion of a mating connector starts to contact the side edges at the upper end face 8B and moves to the contact portion 8A for completing the contact. Thus, if the terminal of a mating connector is displaced in the widthwise direction, it is gradually moved toward the center for correction.

As shown in FIGS. 6(A)-(C), the contact portion 8A has no sloped transitional portions or end faces but stepped ones. The contact portion 8A becomes deeper toward the center so that after the mating terminal reaches the contact portion 8A, it is guided in the widthwise direction. When the mating terminal moves to the stepped down contact portion 8A, the operator obtains a click sense to know that the terminal reaches the contact portion 8A. Both the connectors are locked at the stepped portions. The curved surface of the contact portion 8A makes a point contact with the mating terminal, increasing the contact pressure to provide a reliable connection.

In FIG. 2, the mating connector 20 includes a housing 21 having a peripheral wall 22 and a central wall 23 within a cavity defined by the peripheral wall 22 to provide a plugging cavity 24 for receiving the peripheral wall 6 of the connector 1. A plurality of terminals 25 are supported by the peripheral wall 22 and provided with contact portions 25A arranged in the plugging cavity 24. The terminal 24 is made by stamping a metal sheet to provide a base section 25B and a flexible arm 25C extending from the base section 25B and having the contact portion or projection 25A at its free end that is exposed in the plugging cavity 24. A fixing section 25D extends downward from the base section 25B and press fitted into a fixing slit 21A provided in the housing 21 so that the housing 21 supports the terminal 25. A connection section 25E extends laterally from the base section 25B and is to be soldered to a circuit board P2. The mating connector 20 is not the subject matter of the application and its detailed description is omitted. That is, the mating connector may take a variety of structures.

The above connector is used as follows:

(1) The terminal 3 is pressed to provide an indented contact portion 8A after or before the metal strip is bent in its thicknesswise direction.

(2) When the terminal 3 and the housing 2 are molded together, the metal mold is in contact with side edges of the contact portion 8A in the widthwise direction and the surface of the vertical section 8 in the longitudinal direction. Consequently, the side edges in the widthwise direction is level with the surface of the vertical section 8. The periphery of the indented contact portion 8A is in close contact with the metal mold so that no molten resin enters the contact portion 8A. Even if there is a gap between the metal mold and the terminal at one of the side edges 11, the side edge of the contact portion 8A is inclined gradually so that the gap is so small that no or little molten resin, which has a certain viscosity, enters the contact portion 8A.

(3) As shown in FIG. 2, the connector 1 and the mating connector 20 are connected to circuit boards P1 and P2, respectively, by soldering the connection sections 9 of the terminals 2 and the connection sections 25E of the terminals 25 to the corresponding circuit portions of the circuit boards P1 and P2.

(4) The mating connector 20 is plugged with the connector 1 from above.

(5) The contact portion 25A of the mating connector 20 is guided by the curved portion 10 so as to slide on the vertical section 8 of the terminal 3.

(6) Then, the contact portion 25A passes through the transitional portion or upper end face 8B into the contact portion 8A of the terminal 3. If the terminal 25 is displaced laterally from the regular position, the contact portion 25A begins contacting one of the sloped side edges of the contact portion 8A and is guided toward the central area by the sloped surface.

(7) Thus, the mating terminal 25, even if displaced to either side, is brought into contact with the contact portion 8A of the terminal 2 on both the sides without failure.

The invention claimed is:

1. An electrical connector comprising:

a housing made of an insulative material;

a terminal made of a metal strip bent in a thickness direction thereof and molded together with said housing; and a contact portion indented in said terminal so as to provide a curved surface that extends from side edges thereof to a bottom center thereof, deepening gradually, said contact portion having first tangents to the side edges contacting a first circle and a second tangent to the bottom surface contacting a second circle, said contact portion being formed in an arc of at least one of the first circle and the second circle, at least one of said first circle and said second circle having a diameter greater than a distance between the side edges, said contact portion having a sloped end face in a longitudinal direction thereof, said sloped end face having a length increasing from the side edges toward the bottom center.

2. The electrical connector according to claim 1, wherein said contact portion is made such that the first tangents to said side edges and the second tangent to said bottom share a common circle having a diameter that is greater than the distance between said side edges.

3. The electrical connector according claim 1, wherein said contact portion has a stepped end face in a longitudinal direction thereof.

* * * * *